US005609332A

United States Patent [19]

Hassell

[11] Patent Number: 5,609,332

[45] Date of Patent: Mar. 11, 1997

[54] DEVICE FOR LIFTING AND HOLDING CABINETS

[76] Inventor: Clayton Hassell, 1055 W. 1600 North, Lehi, Utah 84043

[21] Appl. No.: 558,692

[22] Filed: Nov. 14, 1995

[51] Int. Cl.[6] ..... B25H 1/08

[52] U.S. Cl. ..... 269/16; 269/60; 269/61; 269/904; 269/252; 254/103

[58] Field of Search ..... 269/60, 61, 252, 269/253, 254, 904, 16; 254/103, 99, 425

[56] References Cited

U.S. PATENT DOCUMENTS

| | | | |
|---|---|---|---|
| 1,823,204 | 9/1931 | Long | 269/60 |
| 2,814,099 | 11/1957 | Knittel | 269/61 |
| 3,325,162 | 6/1967 | Lukas | 269/60 |
| 4,955,592 | 9/1990 | Brennan | 269/904 |

*Primary Examiner*—Robert C. Watson
*Attorney, Agent, or Firm*—Terry M. Crellin

[57] ABSTRACT

A device for lifting and holding a cabinet to be mounted to a wall or ceiling. A base member is mounted on a suitable support, and a hollow, linear, elongate drive shaft extends upwardly from the base member. An elongate lift shaft is received coaxially within the drive shaft, with the lift shaft being driven in a longitudinal movement up and down within the drive shaft. At least two elongate, hollow stabilizer shafts are spaced outwardly from the drive shaft, with a longitudinal axis of each stabilizer shaft being substantially parallel with a longitudinal axis of the drive shaft. An elongate idler shaft is received coaxially within each stabilizer shaft, with each idler shaft being movable longitudinally within its respective stabilizer shaft so that the upper end of the idler shaft can move up and down relative to the upper end of the respective stabilizer shaft. A planar lift plate is attached to the upper end of the lift shaft and the upper ends of each of the idler shafts so that the lift plate moves up and down as the upper ends of the lift shaft and the idler shafts move up and down. The lift plate is constrained to remain substantially perpendicular to the drive shaft by the idler shafts as the lift plate moves up and down.

19 Claims, 2 Drawing Sheets

DEVICE FOR LIFTING AND HOLDING CABINETS

BACKGROUND OF THE INVENTION

1. Field of the Invention

The present invention relates to devices used in lifting and holding a bulky item, such as a cabinet or a ceiling frame, in proper position during installation of the item. In particular, the invention relates to a lifting device that can be used by an installer to lift, position and install and item such as a heavy, bulky, kitchen cabinet without requiring the help of a second person.

2. State of the Art

Normally, when installing an item such as a cabinet or ceiling frame, it is necessary for a helper to lift the cabinet in place against a wall or ceiling while the item is secured to the wall or ceiling by the installer. The use of a helper increases the labor cost of such installation. It would be highly desirable to provide apparatus that can be safely operated by one person to lift and hold a cabinet in place while that person secures the cabinet to the wall or ceiling.

The use of apparatus to lift heavy items is, of course, known in the prior art. U.S. Pat. Nos. 1,725,329; 3,365,080; and 4,027,802 disclose apparatus for lifting ceiling frames. While these devices disclose hoists for lifting ceiling frames, they do not disclose or suggest devices which are suitable for installing cabinets. U.S. Pat. No. 1,725,329 discloses a device for raising a platform, but there is no suggestion that the platform could be used for lifting and holding cabinets or ceiling frames in place while the cabinets or ceiling frames are being installed to the wall or ceiling.

U.S. Pat. Nos. 4,715,760; 4,955,592; and 5,322,403 disclosed apparatus that can be used in lifting cabinets and the like during installation to a wall or ceiling. Each of the devices of these patents utilizes a single support shaft extending upwardly from a base member to support the cabinet. The cabinet must be precariously balanced on the upper end of the single support shaft. The device of U.S. Pat. No. 4,715,760 has a small platform at the top of the support shaft upon which the cabinet is placed; however, the small platform provides only minimal stabilization for the cabinet as it is being lifted. The cabinet must be carefully balanced and steadied during the lifting operation. U.S. Pat. No. 4,955,592 utilizes a larger platform at the upper end of the lift shaft, but the cabinet must still be carefully balanced and steadied during the lifting operation to prevent unsafe tilting of the cabinet.

U.S. Pat. No. 5,322,403 utilizes a tripod that supports the lift shaft intermediate its top and bottom ends. The lift shaft has a massive counterweight that extends to the floor, and the portion of the lift shaft that extends below the top of the tripod is connected rigidly with the bottom of the legs of the tripod. This arrangement stabilizes the lift shaft against unsafe tilting, but the apparatus itself becomes bulky and hard to use.

OBJECTIVE AND BRIEF DESCRIPTION OF THE INVENTION

The principal objective of the invention is to provide a new and improved device that is inexpensive, simple in construction and easily used by one person to lift and hold a bulky item such as a cabinet or ceiling frame during installation of the item on a wall or ceiling. The lift device incorporates a lifting platform that has at least two stabilizer support shafts in addition to the primary lift shaft. The combined action of the lift shaft and the stabilizer shafts maintain the lifting platform in a stable, level position thus preventing the item being lifted from tilting or leaning during the lifting operation. The item being lifted is thus maintained in a safe, stable, level position.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
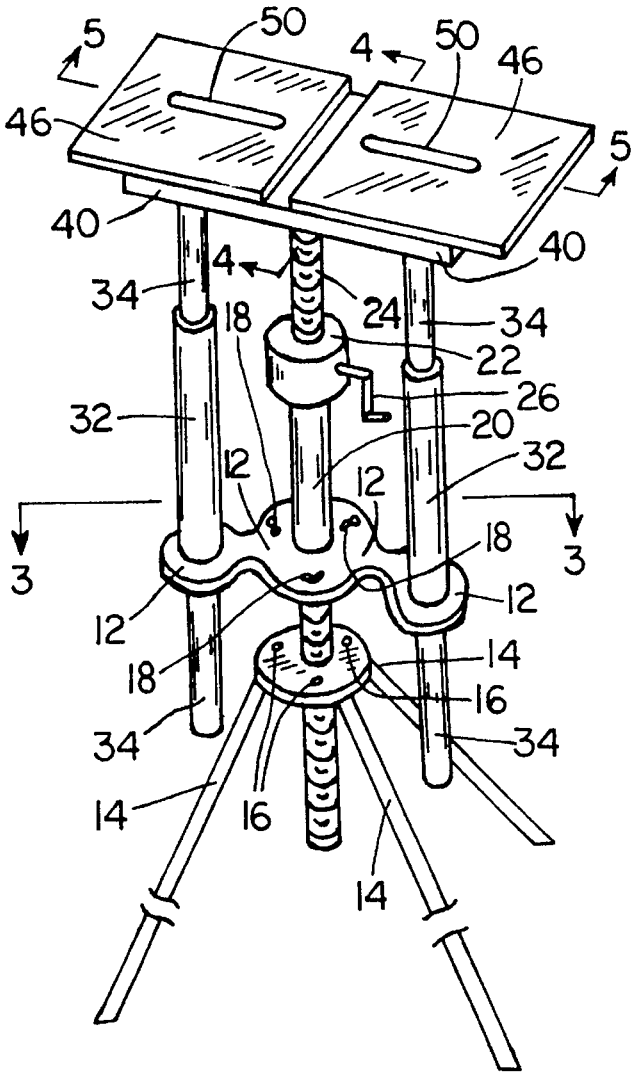
FIG. 1 is a pictorial representation of a device in accordance with the present invention for lifting and holding a bulky/item such as a kitchen cabinet.
Figure 2:
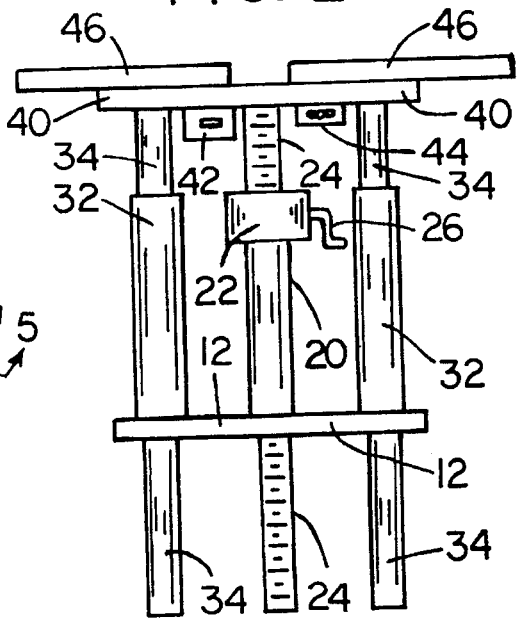
FIG. 2 is a front elevation view of the device of FIG. 1, with the tripod shown in FIG. 1 being omitted.
Figure 3:
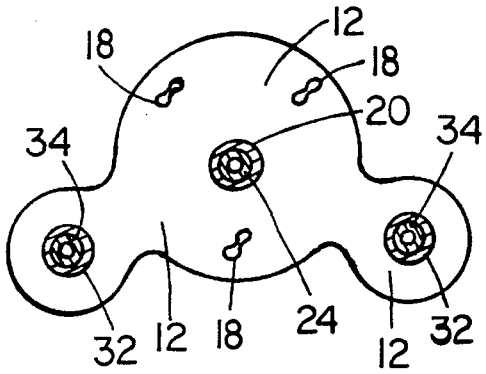
FIG. 3 is a cross-section through the lift shaft and stabilizer shafts of the device of FIG. 1 taken along line 3—3 of FIG. 1.

Referring now to FIGS. 1–5 of the drawings, there is shown a preferred embodiment of a device in accordance with the present invention for lifting and holding a heavy or bulky item such as a cabinet that is to be mounted to a wall or ceiling. The device of the present invention is capable of accurately positioning and safely holding an item such as a kitchen cabinet against a wall or ceiling while an installer secures the item to the wall or ceiling. The installer can lift the cabinet into proper position in a safe, simple procedure that does not require the help of a second person.

The device comprises a base member 12 that can be mounted on a suitable support such as the tripod 14 shown in the drawings. The base member 12 can also be mounted on a floor, a counter top, a table or any other appropriate support. When the base member 12 is mounted on a tripod 14, it is convenient to provide wing screws 18 that extend downwardly through the base member 12 and engage threaded openings 16 in the tripod 14 to secure the base member to the tripod 14.

The base member 12 has a hollow, linear, elongate drive shaft 20 extending upwardly therefrom. A worm gear drive 22 is attached to the upper end of the drive shaft 20, and an elongate lift shaft 24 is received coaxially within the drive shaft 20. The lift shaft 24 has an upper end that extends upwardly from the worm gear 22, and the worm gear 22 is capable of moving the elongate lift shaft 24 in a longitudinal movement up and down within the drive shaft 20 such that (1) the upper end of the lift shaft 24 moves upwardly away from the worm gear 22 when the lift shaft 24 moves upwardly in the drive shaft 20, and (2) the upper end of the lift shaft 24 moves downwardly toward the worm gear when the lift shaft 24 moves downwardly in the drive shaft 20.

In the embodiment of the device of the present invention as illustrated in the drawings, the base member 12 is adapted to be attached to the top of a tripod 14. The tripod 14 can have telescoping legs as is well known in the art so that the elevation of the top of the tripod 14 can be adjusted over a relatively large distance. It is advantageous, however that the top of the tripod 14 not extend above the floor much higher than the waist of a person who is installing the cabinets. This limits the amount of lifting that the installer has to do in the initial placement of the cabinet that is to be installed on the lift device itself.

To provide adequate travel for the lift shaft 24 so that the device of the preset invention can be used to elevate a cabinet from waist height of an installer to the ceiling of a room, it is advantageous to elongate the lift shaft 24 so that this shaft can extend below the base member 12 and the top of the tripod 14 to which the base member 12 is mounted. To accommodate the extended length of the lift shaft 24, an opening is advantageously provided in the base member 12 of the device as well as a corresponding opening in the top of the tripod 14 through which the extended lift shaft 24 can pass. The openings in the base member 12 and the top of the tripod 14 would, of course, be coaxial with the drive shaft 20 and the lift shaft 24.

For those applications wherein the lifting device of the present invention is supported on a counter top or a table top, the travel of the lift shaft 24 need not be of such magnitude as to require the extension of the lift shaft 24 below the base member 12. In those instances, the drive shaft 20 can be of sufficient length to house the lift shaft 24, without need for the lift shaft 24 to extend from the bottom of the drive shaft 20 and through the base member 12. Also, if the lift shaft 24 is provided with a compound telescoping action, i.e., the lift shaft 24 itself includes a telescoping extension such that the lift shaft 24 can telescope upwardly from the drive shaft and the telescoping extension can telescope upwardly from the lift shaft 24, there is no necessity for the lift shaft 24 to extend from the bottom of the drive shaft 20 and through the base member 12.

The essence of the present invention is the provision of at least two elongate, hollow stabilizer shafts 32 spaced outwardly from said drive shaft 20 so that each stabilizer shaft is held in fixed position relative to the drive shaft, with the longitudinal axis of each stabilizer shaft 32 being substantially parallel with a longitudinal axis of the drive shaft 20. Each of the stabilizer shafts 32 is positioned in a radial direction from the drive shaft 20 that is different from the radial direction of any other stabilizer shaft 32.

An elongate idler shaft 34 is received coaxially within each of the stabilizer shafts 32. Each of the idler shafts 34 have an upper end that extends upwardly away from an upper end of a respective stabilizer shaft 32. In addition, each of the idler shafts 34 is movable longitudinally within its respective stabilizer shaft 32 so that the upper end of each idler shaft 34 can move up and down relative to the upper end of the respective stabilizer shaft 32.

A planar lift plate 40 is attached to the upper end of the lift shaft 24 and the upper ends of each of the idler shafts 34 so that the lift plate 40 moves up and down as the upper ends of said lift shaft 24 and the idler shafts 34 move up and down. The item that is to be lifted is placed on the lift plate 40. The lift plate 40 is oriented substantially perpendicular to the drive shaft 20, and the lift plate 40 is constrained by the action of the idler shafts 34 to remain substantially perpendicular to the drive shaft 20 and the idler shafts 34 as the lift plate 40 moves up and down. By constraining the lift plate 40 to move in a stable, substantially level position, the item being lifted will be maintained in a stable, level position.

It is advantageous to provide the lift plate 40 with a tray 42 that is attached to the lower surface of the lift plate 40. The tray 42 is conveniently used to hold a supply of screws that are to in turn be used in securing the item to the wall or ceiling. The lift plate 40 can also advantageously have a bubble level 44 attached to its lower surface. The bubble level 44 provides means for the installer to confirm that the lift plate 40 and the item being lifted remain in a steady, level condition.

Means are provided for operating the worm gear 22 to move the lift shaft 24 and thereby raise and lower the lift plate 40. Advantageously, the means for operating the worm gear 22 is a hand operated crank 26. Alternatively, an electric motor could be used in place of the hand crank 26. It is conceivable that the worm gear 22 and its associated means for operation could be replaced by an alternate means for raising and lowering the lift shaft 24. For example, a hydraulic system could be used to move the lift shaft 24 back and forth within the drive shaft 20.

The device of the present invention is used by placing the base member 12 on a suitable support such as the tripod 14 shown in FIG. 1. The item to be lifted and supported , such as a kitchen cabinet, is then placed on the lift plate 40, and the worm gear 22 is operated to move the lift shaft 24 upwardly until the item is in proper position to be installed to the wall or ceiling. As mentioned previously, the stabilizer shafts 32 are critical and essential to the safe, reliable operation of the device of the present invention. The stabilizer shafts 32 constrain the lift plate 40 to remain level and thereby maintain the cabinet that is being lifted in a safe, stable, level orientation.

In the preferred embodiment of the invention, shown in FIGS. 1–5, only two elongate, hollow stabilizer shafts 32 are employed, with an elongate idler shaft 34 for each stabilizer shaft 32. When only two stabilizer shafts 32 are employed, the radial directions of the stabilizer shafts 32 make an angle of at least about 120 degrees with each other. Of course, the stabilizer shafts 32 can be diametrically opposed, i.e., the radial directions of the stabilizer shafts 32 make an angle of substantially 180 degrees from each other with respect to the drive shaft 20. In an alternative embodiment of the invention, three elongate, hollow stabilizer shafts 32 can be provided, with an elongate idler shaft 32 for each stabilizer shaft 32. When three stabilizer shafts 32 are employed, the radial directions of the stabilizer shafts 34 make an angle of substantially 120 degrees with each other as illustrated in FIG. 6.

Each of the stabilizer shafts 32 is held in its fixed position spaced from and parallel to the drive shaft 20 by a support member that extends from the drive shaft 20 to the stabilizer shafts 32. As shown in the drawings, the lower ends of the stabilizer shafts 32 and the drive shaft 20 lie in a common plane that is substantially perpendicular to the longitudinal axis of the drive shaft 20, and the support member comprises the base member 12 which is attached to the lower ends of the stabilizer shafts 32 and the drive shaft 20.

It is advantageous to provide the lift plate 40 with a pair of planar extension plates 46 that are slidably attached to the lift plate 40 so that the extension plates 46 lie flatwise on the lift plate 40. The extension plates 46 can move in a direction diametrically opposed to each other so as to increase the breadth of the lift plate 40 to accommodate a wide cabinet or other item that is to be lifted and supported by the device of the invention. In the embodiment of the invention as illustrated in the drawings, the extension plates 46 lie flatwise on the upper surface of the lift plate 40.

Figure 4:
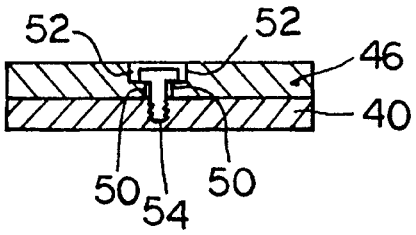
FIG. 4 is a cross-section through the lift plate of the device of FIG. 1 taken along line 4—4 of FIG. 1.
Figure 5:
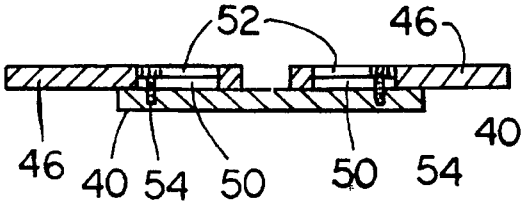
FIG. 5 is a cross-section through the lift plate of the device of FIG. 1 taken along line 5—5 of FIG. 1.
Figure 6:
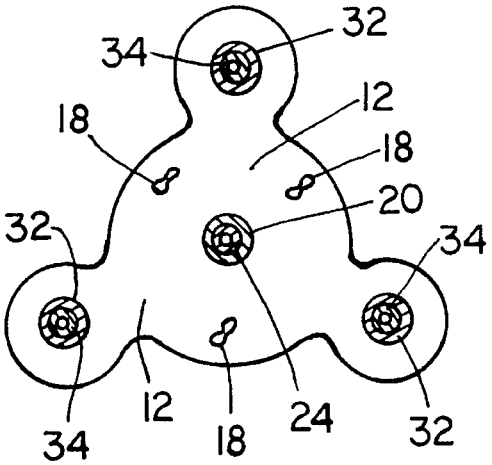
FIG. 6 is a cross-section similar to that of FIG. 3 but showing three stabilizer shafts rather than two.

As best shown in FIGS. 4 and 5, each extension plate 46 has an elongate slot 50 running longitudinally thereof. Each slot 50 is countersunk with a groove 52 on the exterior sides of the extension plates. A screw 54 extends through the slot 50 in each of the extension plates 46, with the head of each screw being received in the countersunk groove 52 in the respective extension plate 46. The screw 54 for each extension plate 46 is threaded into a threaded opening in the lift plate 46. By loosening the screw 54 for each extension plate 46, the extension plate 46 can be moved back and forth over the surface of the lift plate along the movement allowed by the slot 50 in the respective extension plate 46. When the extension plates 46 are extended to their desired position, the respective screws 54 can be tightened so as to lock the extension plates 46 in that position.

Although preferred embodiments of the lifting device of the present invention have been illustrated and described, it is to be understood that the present disclosure is made by way of example and that various other embodiments are possible without departing from the subject matter coming within the scope of the following claims, which subject matter is regarded as the invention.

I claim:

1. A device for lifting and holding a heavy or bulky item such as a cabinet that is to be mounted to a wall or ceiling, whereby the item can be accurately positioned and safely held in position while an installer secures the item to the wall or ceiling, said device comprising a base member that can be mounted on a suitable support such as a floor, a counter top, a table or a tripod;

said base member having a hollow, linear, elongate drive shaft extending upwardly therefrom;

a worm gear drive positioned at the upper end of said drive shaft;

an elongate lift shaft received coaxially within said drive shaft, said lift shaft having an upper end that extends upwardly from the worm gear, said worm gear being capable of moving the elongate lift shaft in a longitudinal movement up and down within said drive shaft such that (1) the upper end of said lift shaft moves upwardly away from said worm gear when the lift shaft moves upwardly in said drive shaft, and (2) the upper end of said lift shaft moves downwardly toward said worm gear when the lift shaft moves downwardly in said drive shaft;

at least two elongate, hollow stabilizer shafts spaced outwardly from said drive shaft so that each stabilizer shaft is held in fixed position relative to said drive shaft, with a longitudinal axis of each stabilizer shaft being substantially parallel with a longitudinal axis of said drive shaft;

each of said stabilizer shafts being positioned in a radial direction from said drive shaft that is different from the radial direction of any other stabilizer shaft;

an elongate idler shaft received coaxially within each of said stabilizer shafts, each of said idler shafts having an upper end that extends upwardly from an upper end of a respective stabilizer shaft;

each of said idler shafts being movable longitudinally within its respective stabilizer shaft so that the upper end of the idler shaft can move up and down relative to the upper end of the respective stabilizer shaft;

a planar lift plate attached to the upper end of said lift shaft and the upper ends of each of said idler shafts so that the lift plate moves up and down as the upper ends of said lift shaft and said idler shafts move up and down, with said lift plate being oriented substantially perpendicular to said drive shaft and said idler shafts and constrained to remain substantially perpendicular to said drive shaft and said idler shafts as the lift plate moves up and down; and means for operating said worm gear to move said lift shaft, whereby said device is used by placing said base member on a suitable support, placing said item on said lift plate and operating said worm gear to move said lift shaft upwardly until said item is in proper position to be installed to the wall or ceiling.

2. A device in accordance with claim 1 wherein said base member is mounted on a tripod.

3. A device in accordance with claim 1 wherein said worm gear is operated by a hand manipulated crank.

4. A device in accordance with claim 1 wherein there are two elongate, hollow stabilizer shafts, with an elongate idler shaft for each stabilizer shaft; and the radial directions of the stabilizer shafts make an angle of at least about 120 degrees with each other.

5. A device in accordance with claim 1 wherein there are three elongate, hollow stabilizer shafts, with an elongate idler shaft for each stabilizer shaft; and the radial directions of the stabilizer shafts make an angle of substantially 120 degrees with each other.

6. A device in accordance with claim 1 wherein each of said stabilizer shafts is held in its fixed position spaced from and parallel to said drive shaft by a support member that extends from said drive shaft to said stabilizer shaft.

7. A device in accordance with claim 6 wherein the lower ends of said stabilizer shafts and the drive shaft lie in a common plane that is substantially perpendicular to the longitudinal axis of said drive shaft; and said support member comprises a planar plate that is attached to the lower ends of said stabilizer shafts and said drive shaft.

8. A device in accordance with claim 1 wherein said planar lift plate has a pair of planar extension plates slidably attached thereto so that said extension plates lie flatwise on said lift plate and can move in a direction diametrically opposed to each other.

9. A device in accordance with claim 1 wherein said planar lift plate has a tray attached to its lower surface, with said tray being adapted to hold a supply of screws that are to be used in securing said item to the wall or ceiling.

10. A device in accordance with claim 1 wherein said planar lift plate has a bubble level attached to its lower surface.

11. A device for lifting and holding a heavy or bulky item such as a cabinet that is to be mounted to a wall or ceiling, whereby the item can be accurately positioned and safely held in position while an installer secures the item to the wall or ceiling, said device comprising a base member that can be mounted on a suitable support such as a floor, a counter top, a table or a tripod;

said base member having a hollow, linear, elongate drive shaft extending upwardly therefrom;

an elongate lift shaft received coaxially within said drive shaft, said lift shaft having an upper end that extends upwardly from an upper end of said drive shaft;

means for moving the elongate lift shaft in a longitudinal movement up and down within said drive shaft such that (1) the upper end of said lift shaft moves upwardly away from the upper end of said drive shaft when the lift shaft moves upwardly in said drive shaft, and (2) the upper end of said lift shaft moves downwardly toward said upper end of said drive shaft when the lift shaft moves downwardly in said drive shaft;

at least two elongate, hollow stabilizer shafts spaced outwardly from said drive shaft so that each stabilizer shaft is held in fixed position relative to said drive shaft, with a longitudinal axis of each stabilizer shaft being substantially parallel with a longitudinal axis of said drive shaft;

each of said stabilizer shafts being positioned in a radial direction from said drive shaft that is different from the radial direction of any other stabilizer shaft;

an elongate idler shaft received coaxially within each of said stabilizer shafts, each of said idler shafts having an upper end that extends upwardly from an upper end of a respective stabilizer shaft;

each of said idler shafts being movable longitudinally within its respective stabilizer shaft so that the upper end of the idler shaft can move up and down relative to the upper end of the respective stabilizer shaft; and a planar lift plate attached to the upper end of said lift shaft and the upper ends of each of said idler shafts so that the lift plate moves up and down as the upper ends of said lift shaft and said idler shafts move up and down, with said lift plate being oriented substantially perpendicular to said drive shaft and said idler shafts and constrained to remain substantially perpendicular to said drive shaft and said idler shafts as the lift plate moves up and down, whereby said device is used by placing said base member on a suitable support, placing said item on said lift plate and moving said lift shaft upwardly until said item is in proper position to be installed to the wall or ceiling.

12. A device in accordance with claim 11 wherein said base member is mounted on a tripod.

13. A device in accordance with claim 11 wherein there are two elongate, hollow stabilizer shafts, with an elongate idler shaft for each stabilizer shaft; and the radial directions of the stabilizer shafts make an angle of at least about 120 degrees with each other.

14. A device in accordance with claim 11 wherein there are three elongate, hollow stabilizer shafts, with an elongate idler shaft for each stabilizer shaft; and the radial directions of the stabilizer shafts make an angle of substantially 120 degrees with each other.

15. A device in accordance with claim 11 wherein each of said stabilizer shafts is held in its fixed position spaced from and parallel to said drive shaft by a support member that extends from said drive shaft to said stabilizer shaft.

16. A device in accordance with claim 15 wherein the lower ends of said stabilizer shafts and the drive shaft lie in a common plane that is substantially perpendicular to the longitudinal axis of said drive shaft; and said support member comprises a planar plate that is attached to the lower ends of said stabilizer shafts and said drive shaft.

17. A device in accordance with claim 11 wherein said planar lift plate has a pair of planar extension plates slidably attached thereto so that said extension plates lie flatwise on said lift plate and can move in a direction diametrically opposed to each other.

18. A device in accordance with claim 11 wherein said planar lift plate has a tray attached to its lower surface, with said tray being adapted to hold a supply of screws that are to be used in securing said item to the wall or ceiling.

19. A device in accordance with claim 11 wherein said planar lift plate has a bubble level attached to its lower surface.

* * * * *